US007886756B2

(12) United States Patent
Chen

(10) Patent No.: US 7,886,756 B2
(45) Date of Patent: Feb. 15, 2011

(54) UMBRELLA HANDLE QUICK-RELEASE STRUCTURE

(75) Inventor: Tian-Fu Chen, Fujian (CN)

(73) Assignee: Futao Industrial Co., Ltd., Fujian (CN)

( * ) Notice: Subject to any disclaimer, the term of this patent is extended or adjusted under 35 U.S.C. 154(b) by 0 days.

(21) Appl. No.: 12/620,043

(22) Filed: Nov. 17, 2009

(65) Prior Publication Data

US 2011/0011431 A1 Jan. 20, 2011

(30) Foreign Application Priority Data

Jul. 20, 2009 (CN) ..... 2009 1 0112263

(51) Int. Cl.
*A45B 19/08* (2006.01)

(52) U.S. Cl. ..... 135/25.4; 135/15.1; 135/24

(58) Field of Classification Search ..... 135/15.1, 135/25.1, 25.4, 25.41
See application file for complete search history.

(56) References Cited

U.S. PATENT DOCUMENTS 4,518,162 A * 5/1985 Oates ..... 482/93
5,186,197 A * 2/1993 Lavine ..... 135/25.4
5,458,144 A * 10/1995 Lavine ..... 135/24
6,220,260 B1 * 4/2001 Sachs ..... 135/15.1
6,221,029 B1 * 4/2001 Mathis et al. ..... 600/564
6,779,536 B2 * 8/2004 Kuo ..... 135/24
2007/0157958 A1 * 7/2007 Kuo ..... 135/25.4

* cited by examiner

*Primary Examiner*—David Dunn
*Assistant Examiner*—Danielle Jackson
(74) *Attorney, Agent, or Firm*—Banger Shia

(57) ABSTRACT

An umbrella handle quick-release structure includes a positioning member, a spring, and an inner sleeve. The positioning member is fixed at a lower end of an umbrella rod. The inner sleeve is secured to a mounting hole of an umbrella handle. The inner sleeve has an axial insertion hole for insertion of the umbrella rod, an axial side groove at a side wall thereof for the positioning member to slide therein along with the insertion of the umbrella rod, a transverse groove for the positioning member to slide therein along with turning of the umbrella rod, and an axial positioning groove for positioning of the positioning member after being turned. The transverse groove has a first end interconnected with a lower end of the axial side groove and a second end interconnected with the axial positioning groove. An upper end of the axial positioning groove is higher than the transverse groove. The spring is located between a bottom of the mounting hole and a lower end of the umbrella rod. The present invention is convenient, easy and safe to be disassembled, can satisfy the consumer's demand for diversification, and is advantageous for recycle and environmental protection.

7 Claims, 4 Drawing Sheets

UMBRELLA HANDLE QUICK-RELEASE STRUCTURE

BACKGROUND OF THE INVENTION

1. Field of the Invention

The present invention relates to an umbrella handle quick-release structure of.

2. Description of the Prior Art

A conventional umbrella handle is fixed to a lower end of an umbrella rod with a fixing member like a pin. In this way, the umbrella handle and the umbrella rod are not easy to be disassembled. It is to difficult to replace a desired umbrella handle according to the consumer's demand, so it is impossible to do it yourself. This cannot satisfy the consumers for diversifying the umbrella. Besides, when the umbrella is unusable, it is disadvantageous to classify and recycle the wastes if the umbrella handle and the umbrella rod are unable to be disassembled, causing the umbrella to be discarded or to be recycled wrongly. It is laborious, inconvenient and unsafe to disassemble the umbrella handle and the umbrella rod.

Accordingly, the inventor of the present invention has devoted himself based on his many years of practical experiences to solve this problem.

SUMMARY OF THE INVENTION

The primary object of the present invention is to provide an umbrella handle quick-release structure, which is convenient, easy and safe to be disassembled, can satisfy the consumer's demand for diversification, and is advantageous for recycle and environmental protection.

In order to achieve the above-mentioned object, there is provided an umbrella handle quick-release structure comprising a positioning member, a spring, and an inner sleeve. The positioning member is fixed at a lower end of an umbrella rod. The inner sleeve is secured to a mounting hole of an umbrella handle. The inner sleeve has an axial insertion hole for insertion of the umbrella rod, an axial side groove at a side wall thereof for the positioning member to slide therein along with the insertion of the umbrella rod, a transverse groove for the positioning member to slide therein along with turning of the umbrella rod, and an axial positioning groove for positioning of the positioning member after being turned. The transverse groove has a first end interconnected with a lower end of the axial side groove and a second end interconnected with the axial positioning groove. An upper end of the axial positioning groove is higher than the transverse groove. The spring is located between a bottom of the mounting hole and a lower end of the umbrella rod.

Preferably, the second end of the transverse groove is interconnected with a central section of the axial positioning groove and a lower end of the axial positioning groove is lower than the transverse groove.

Preferably, the umbrella handle quick-release structure further comprises a pin for preventing the positioning member from sliding out, and the pin is tightly secured in the axial side groove.

Preferably, the pin is in a reverse U shape and has two protrusions at two ends thereof. The axial side groove is formed with two recesses at two side walls of the axial side groove. The pin is inserted in the axial side groove and the two protrusions are engaged with the two recesses to secure the pin in the axial side groove.

Preferably, the spring has a lower end leaning against the bottom of the mounting hole and an upper end fitting on the umbrella rod and engaging with the positioning member.

Preferably, the inner sleeve is integrally formed in the mounting hole of the umbrella handle.

To assemble the present invention, the positioning member is fixed at the lower end of the umbrella rod, and the inner sleeve is fixed in the mounting hole of the umbrella handle, and the spring is placed on the bottom of the mounting hole. The umbrella rod is inserted in the inner sleeve through the axial insertion hole. The positioning member is located in the axial side groove. The umbrella rod is turned at a certain angle, and the positioning member is slid through the transverse groove to the axial positioning groove. The positioning member urged by the spring is positioned at the upper end of the axial positioning groove, such that the umbrella handle and the umbrella rod are positioned in place to achieve the assembly of the umbrella handle and the umbrella rod.

To disassemble the present invention, the umbrella rod is pressed inward for the positioning member to be slid in the transverse groove, and then the umbrella rod is turned reversely at a certain angle for the positioning member to be slid in the axial side groove. At this time, the umbrella rod brings the positioning member and the pin to disengage from the axial insertion hole, such that the umbrella handle and the umbrella rod are separated with ease.

The present invention is easy to be disassembled and replaced with a desired umbrella handle so as to satisfy the consumer's demand for diversification. Besides, when the umbrella is unusable, it is advantageous to classify and recycle the wastes because the umbrella handle and the umbrella rod are disassembled with ease.

The present invention can be provided with the pin to ensure a tight connection between the umbrella handle and the umbrella rod.

DETAILED DESCRIPTION OF THE PREFERRED EMBODIMENTS

Embodiments of the present invention will now be described, by way of example only, with reference to the accompanying drawings.

Figure 1:
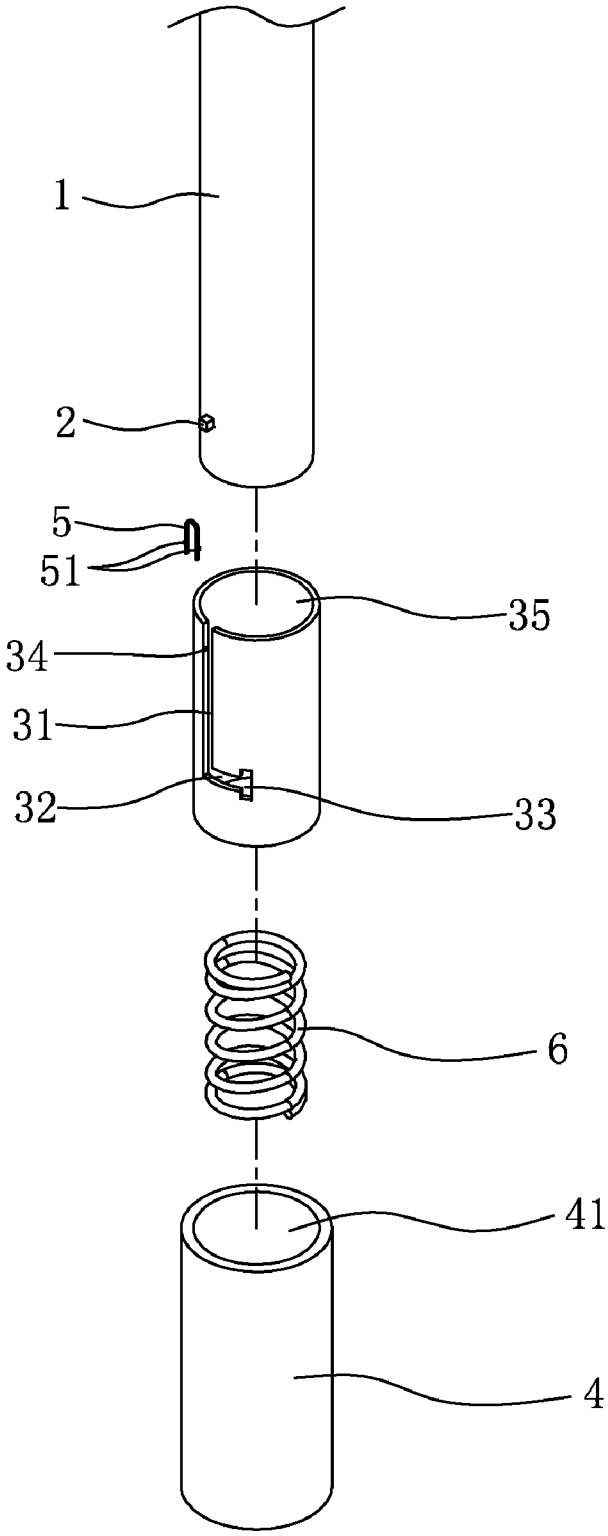
FIG. 1 is an exploded view of the present invention.

As shown in FIG. 1, an umbrella handle quick-release structure according to a preferred embodiment of the present invention comprises a positioning member 2, a spring 6, and an inner sleeve 3. The positioning member 2 is fixed at a lower end of an umbrella rod 1. The positioning member 2 can be either integrally formed with the umbrella rod 1 or separately formed and then to be connected to the umbrella rod 1. The inner sleeve 3 is secured to a mounting hole 41 of an umbrella handle 4. The inner sleeve 3 has an axial insertion hole 35 for insertion of the umbrella rod 1, an axial side groove 31 at a side wall thereof for the positioning member 2 to slide therein along with the insertion of the umbrella rod 1, a transverse groove 32 for the positioning member 2 to slide therein along with turning of the umbrella rod 1, and an axial positioning groove 33 for positioning of the positioning member 2 after being turned. The transverse groove 32 has a first end interconnected with a lower end of the axial side groove 31 and a second end interconnected with the axial positioning groove 33. In this embodiment, the second end of the transverse groove 32 is interconnected with a central section of the axial positioning groove 33 so that an upper end of the axial positioning groove 33 is higher than the transverse groove 32 and a lower end of the axial positioning groove 33 is lower than the transverse groove 32. The transverse groove 32 can be interconnected with the lower end of the axial positioning groove 33 so that the upper end of the axial positioning groove 33 is higher than the transverse groove 32, not shown in the drawings. The spring 6 is located between a bottom of the mounting hole 41 and a lower end of the umbrella rod 1.

The quick-release structure further comprises a pin 5 to prevent the positioning member 2 from sliding out. The pin 5 is tightly secured in the axial side groove 31. The pin 5 is in a reverse U shape and has two protrusions 51 at two ends thereof. The axial side groove 31 is formed with two recesses 34 at two side walls of the axial side groove 31. The pin 5 is inserted in the axial side groove 31 and the two protrusions 51 are engaged with the two recesses 34 so as to secure the pin 5 in the axial side groove 31.

The spring 6 has a lower end leaning against the bottom of the mounting hole 41 and an upper end fitting on the umbrella rod 1 and engaging with the positioning member 2.

Figure 2:
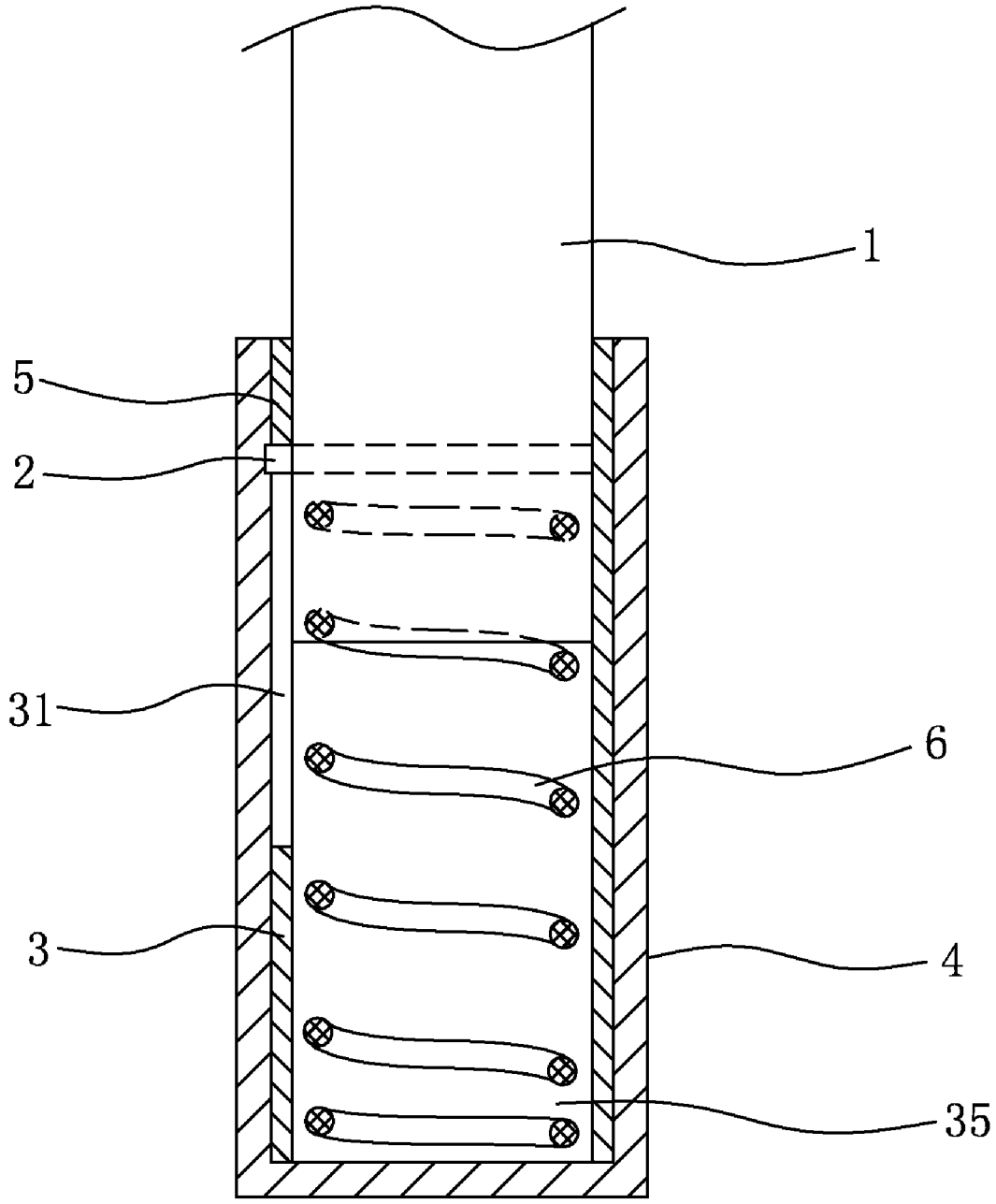
FIG. 2 is a cross-sectional view of the present invention during assembly.
Figure 3:
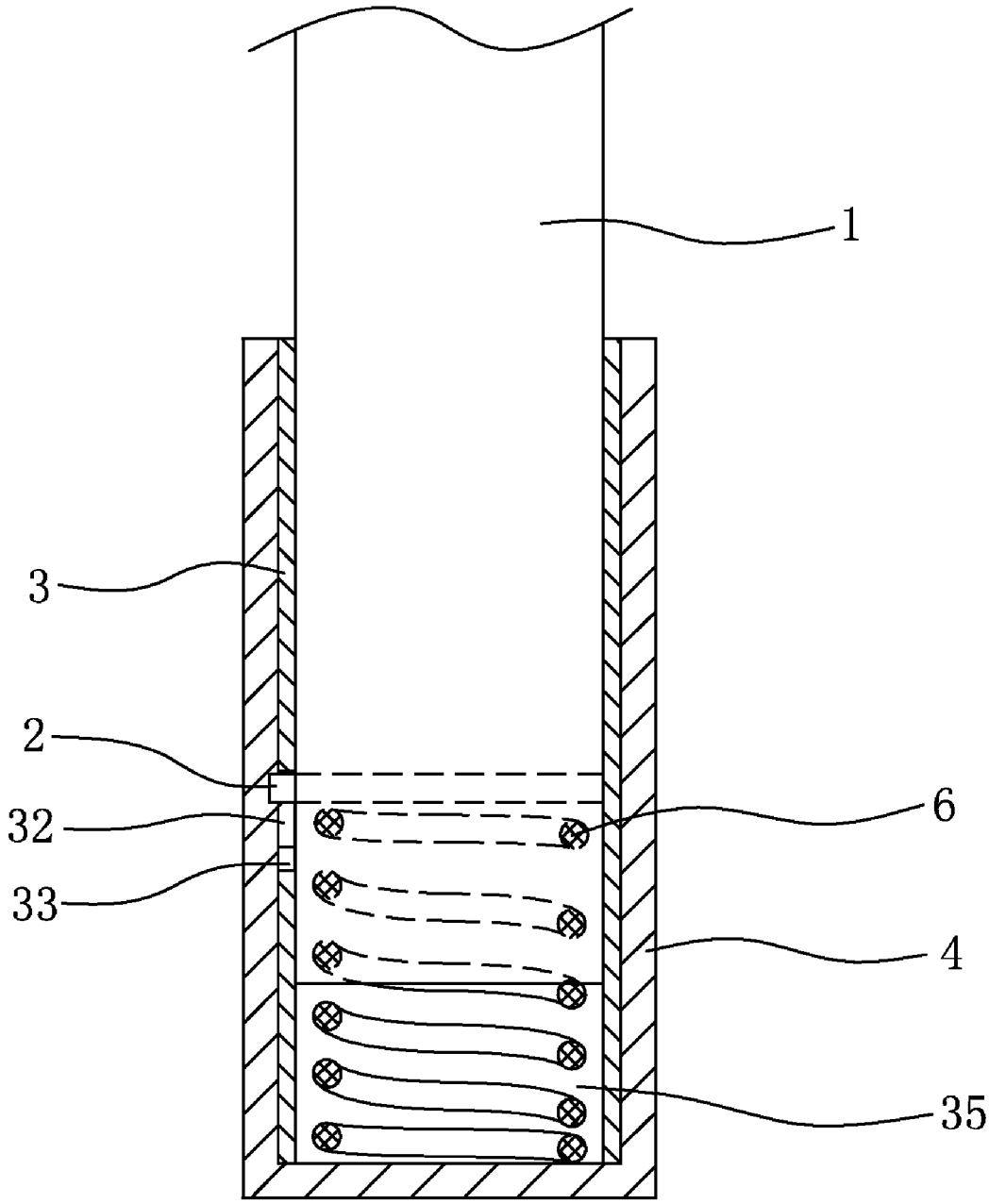
FIG. 3 is a cross-sectional view of the present invention in a positioning state.
Figure 4:
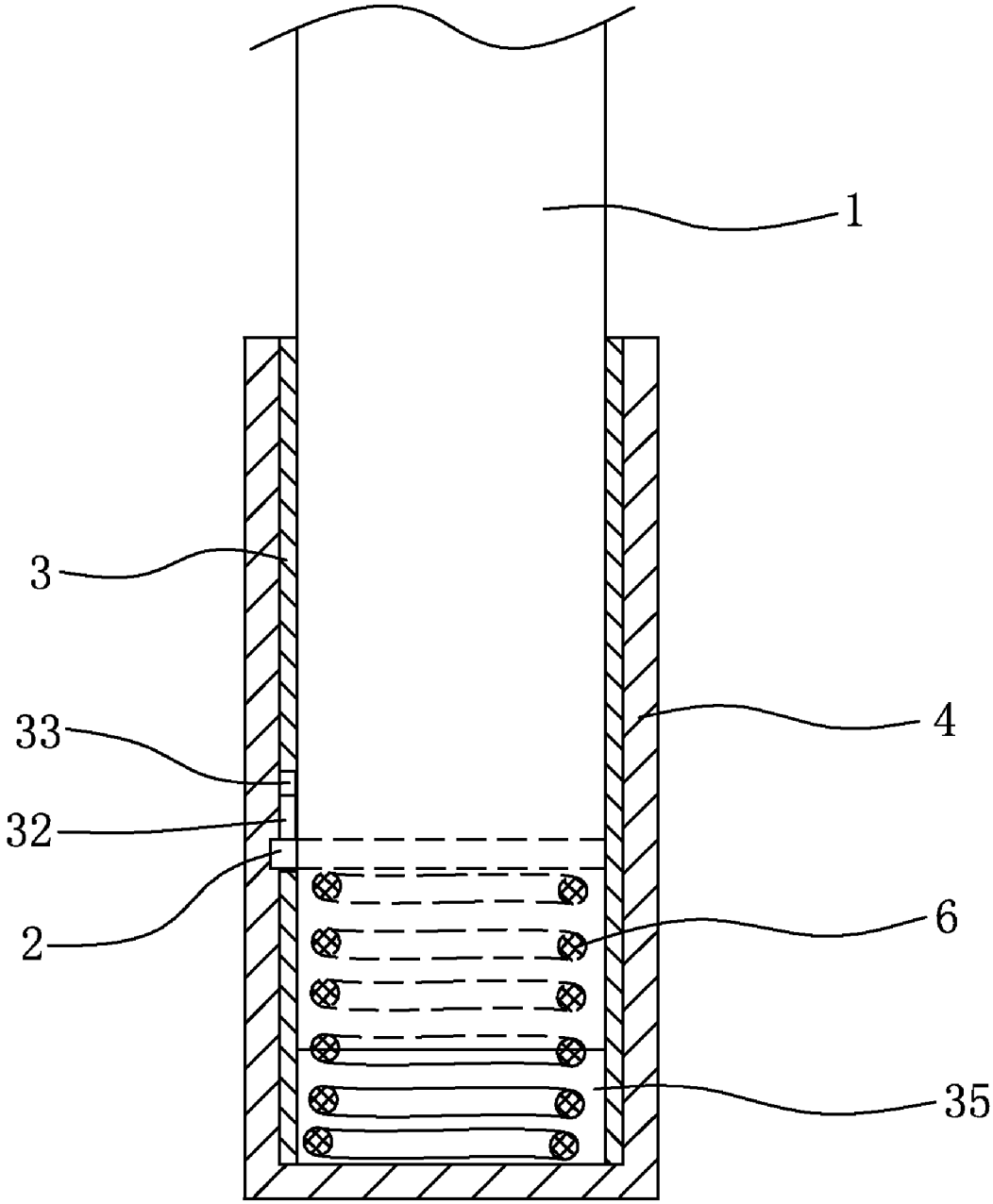
FIG. 4 is a cross-sectional view of the present invention in another positioning state.

To assemble the present invention, as shown in FIGS. 2 and 3, the positioning member 2 is fixed at the lower end of the umbrella rod 1, and the inner sleeve 3 is fixed in the mounting hole 41 of the umbrella handle 4, and the spring 6 is placed on the bottom of the mounting hole 41. The umbrella rod 1 is inserted in the inner sleeve 3 through the axial insertion hole 35. The positioning member 2 is located in the axial side groove 31. The umbrella rod 1 is turned at a certain angle, and the positioning member 2 is slid through the transverse groove 32 to the axial positioning groove 33. The positioning member 2 urged by the spring 6 is positioned at the upper end of the axial positioning groove 33, such that the umbrella handle 4 and the umbrella rod 1 are positioned in place to achieve the assembly of the umbrella handle 4 and the umbrella rod 1. When the positioning member 2 is slid downward by a force and fallen at the lower end of the axial positioning groove 33, the umbrella handle 4 and the umbrella rod 1 are positioned to prevent the positioning member 2 from turning reversely to cause disengagement of the umbrella handle 4. Even though the user places the umbrella upside down and turns the umbrella handle 4 unintentionally, as shown in FIG. 4, to result in that the positioning member 2 slides out from the axial positioning groove 33 to the axial side groove 31 through the transverse groove 32. The positioning member 2 is still restricted by the pin 5 and is unable to disengage from the umbrella handle 4.

To disassemble the present invention, the umbrella rod 1 is pressed inward for the positioning member 2 to be slid in the transverse groove 32, and then the umbrella rod 1 is turned reversely at a certain angle for the positioning member 2 to be slid in the axial side groove 31. At this time, the umbrella rod 1 brings the positioning member 2 and the pin 5 to to disengage from the axial insertion hole 35, such that the umbrella handle 4 and the umbrella rod 1 are separated with ease.

In this embodiment, the inner sleeve 3 can be integrally formed in the mounting hole 41 of the umbrella handle 4.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An umbrella handle quick-release structure, comprising a positioning member, a spring, and an inner sleeve, the positioning member being fixed at a lower end of an umbrella rod, the inner sleeve being secured to a mounting hole of an umbrella handle, the inner sleeve having an axial insertion hole for insertion of the umbrella rod, an axial side groove at a side wall thereof for the positioning member to slide therein along with the insertion of the umbrella rod, a transverse groove for the positioning member to slide therein along with turning of the umbrella rod, and an axial positioning groove for positioning of the positioning member after being turned, the transverse groove having a first end interconnected with a lower end of the axial side groove and a second end interconnected with the axial positioning groove, an upper end of the axial positioning groove being higher than the transverse groove, the spring being located between a bottom of the mounting hole and a lower end of the umbrella rod, further comprising a pin for preventing the positioning member from sliding out, the pin being tightly secured in the axial side groove.

2. The umbrella handle quick-release structure as claimed in claim 1, wherein the second end of the transverse groove is interconnected with a central section of the axial positioning groove and a lower end of the axial positioning groove is lower than the transverse groove.

3. The umbrella handle quick-release structure as claimed in claim 1, wherein the pin is in a reverse U shape and has two protrusions at two ends thereof, the axial side groove being formed with two recesses at two side walls of the axial side groove, the pin being inserted in the axial side groove and the two protrusions being engaged with the two recesses to secure the pin in the axial side groove.

4. The umbrella handle quick-release structure as claimed in claim 1, wherein the inner sleeve is integrally formed in the mounting hole of the umbrella handle.

5. An umbrella handle quick-release structure, comprising a positioning member, a spring, and an inner sleeve, the positioning member being fixed at a lower end of an umbrella rod, the inner sleeve being secured to a mounting hole of an umbrella handle, the inner sleeve having an axial insertion hole for insertion of the umbrella rod, an axial side groove at a side wall thereof for the positioning member to slide therein along with the insertion of the umbrella rod, a transverse groove for the positioning member to slide therein along with turning of the umbrella rod, and an axial positioning groove for positioning of the positioning member after being turned, the transverse groove having a first end interconnected with a lower end of the axial side groove and a second end interconnected with the axial positioning groove, an upper end of the axial positioning groove being higher than the transverse groove, the spring being located between a bottom of the mounting hole and a lower end of the umbrella rod, wherein the spring has a lower end leaning against the bottom of the mounting hole and an upper end fitting on the umbrella rod and engaging with the positioning member.

6. The umbrella handle quick-release structure as claimed in claim 5, wherein the second end of the transverse groove is interconnected with a central section of the axial positioning groove and a lower end of the axial positioning groove is lower than the transverse groove.

7. The umbrella handle quick-release structure as claimed in claim 5, wherein the inner sleeve is integrally formed in the mounting hole of the umbrella handle.

* * * * *